US007939777B2

(12) United States Patent
Dullni et al.

(10) Patent No.: US 7,939,777 B2
(45) Date of Patent: May 10, 2011

(54) VACUUM INTERRUPTER CHAMBER

(75) Inventors: Edgar Dullni, Ratingen (DE); Dietmar Gentsch, Bochum (DE); Kurt Kaltenegger, Baldingen AG (CH)

(73) Assignee: ABB Technology AG, Zurich (CH)

( * ) Notice: Subject to any disclaimer, the term of this patent is extended or adjusted under 35 U.S.C. 154(b) by 7 days.

(21) Appl. No.: 12/073,995

(22) Filed: Mar. 12, 2008

(65) Prior Publication Data

US 2008/0203063 A1 Aug. 28, 2008

Related U.S. Application Data

(63) Continuation of application No. PCT/EP2006/008558, filed on Sep. 1, 2006.

(30) Foreign Application Priority Data

Sep. 13, 2005 (DE) ..... 10 2005 043 484

(51) Int. Cl.
*H01H 33/66* (2006.01)

(52) U.S. Cl. ..... 218/136; 218/118

(58) Field of Classification Search ..... 218/118, 218/134–139, 77, 147; 428/553, 554, 548, 428/148

See application file for complete search history.

(56) References Cited

U.S. PATENT DOCUMENTS

| | | | | |
|---|---|---|---|---|
| 4,553,007 | A | 11/1985 | Wayland | |
| 4,940,862 | A * | 7/1990 | Santilli | 218/136 |
| 5,302,414 | A | 4/1994 | Alkhimov et al. | |
| 5,438,174 | A * | 8/1995 | Slade | 218/118 |
| 6,574,864 | B1 | 6/2003 | Meissner et al. | |
| 7,132,172 | B2 * | 11/2006 | Buresch et al. | 428/556 |
| 2003/0209286 | A1 | 11/2003 | Leonardi et al. | |
| 2004/0202884 | A1 * | 10/2004 | Buresch et al. | 428/556 |
| 2007/0196570 | A1 * | 8/2007 | Gentsch et al. | 427/180 |

FOREIGN PATENT DOCUMENTS

| | | | |
|---|---|---|---|
| CA | 1098157 | A * | 3/1981 |
| DE | 42 21 011 | A1 | 1/1994 |
| DE | 196 32 573 | A1 | 2/1998 |
| DE | 197 14 654 | A1 | 10/1998 |
| DE | 197 47 242 | A1 | 4/1999 |
| DE | 10 2005 043 484 | B4 | 4/2007 |
| EP | 0 911 425 | A1 | 4/1999 |
| EP | 1 433 867 | A2 | 6/2004 |

(Continued)

OTHER PUBLICATIONS

International Search Report for PCT/DP2006/008558.

(Continued)

*Primary Examiner* — Renee Luebke
*Assistant Examiner* — Marina Fishman
(74) *Attorney, Agent, or Firm* — Buchanan Ingersoll & Rooney PC

(57) ABSTRACT

The disclosure relates to a vacuum interrupter chamber having an insulating ceramic wall, within which contact pieces which move in a vacuum are arranged and are surrounded by a screen between the contact piece and the interrupter chamber wall. In order in this case to improve on the one hand the erosion resistance of the screen and on the other hand the dielectric strength of the arrangement, the disclosure proposes that coatings composed of high-melting-point material or composed of refractory metals be fitted at least partially in the area of the screen or other components within the vacuum interrupter chamber.

15 Claims, 1 Drawing Sheet

FOREIGN PATENT DOCUMENTS

| | | | |
|---|---|---|---|
| GB | 1 316 102 | | 5/1973 |
| GB | 2 055 250 | A | 2/1981 |
| GB | 2 130 795 | A | 6/1984 |
| JP | 4-115431 | A | 4/1992 |
| JP | 4-351819 | A | 12/1992 |
| WO | WO 94/19814 | A1 | 9/1994 |
| WO | WO 2005/078755 | A1 | 8/2005 |
| WO | WO 2006/032522 | A1 | 3/2006 |

OTHER PUBLICATIONS

German Search Report.

International Search Report dated Dec. 12, 2005 for PCT/EP2005/010323 corresponding to U.S. Appl. No. 11/663,438.

German language International Preliminary Report on Patentability and Attached Written Opinion dated Sep. 19, 2006 for PCT/EP2005/010323 corresponding to U.S. Appl. No. 11/663,438.

International Preliminary Report on Patentability and Attached Written Opinion (Forms PCT/IB/373 and PCT/ISA/237) mailed by the International Bureau on Apr. 8, 2008 in corresponding PCT/EP2006/008558.

* cited by examiner

VACUUM INTERRUPTER CHAMBER

RELATED APPLICATIONS

This application claims priority under 35 U.S.C. §119 to German Application DE 10 2005 043 484.3 filed in Germany on Sep. 13, 2005, and as a continuation application under 35 U.S.C. §120 to PCT/EP2006/008558 filed as an International Application on Sep. 1, 2006, designating the U.S., the entire contents of which are hereby incorporated by reference in their entireties.

TECHNICAL FIELD

A vacuum interrupter chamber is disclosed with an insulating ceramic wall, within which contact pieces, which are capable of moving in the vacuum, are arranged and are surrounded concentrically by a shield between the contact piece and the interrupter chamber wall.

BACKGROUND INFORMATION

Vacuum interrupter chambers are used in the low-voltage, medium-voltage and high-voltage range. The contact pieces are located within a vacuum, and the switching operation itself takes place under a vacuum atmosphere. During the switching process, in particular under short-circuit conditions, the aim is to extinguish the arc produced as quickly as possible. Said arc as such is a high-energy plasma flow which generates vaporization processes within the vacuum interrupter chamber. In order that no metallic layer is formed on the inside on the ceramic wall material of the vacuum interrupter chamber after a large number of switching operations, and therefore that the insulation capacity of the unit is reduced, shielding components made from metallic materials with relatively thin walls are generally introduced within the vacuum interrupter chamber and are arranged in the vicinity of the arc gap between the contact pieces and the insulation.

The metal vapor flowing away which is brought about by the switching operation then condenses on the surface of these shields. Furthermore, other high-energy plasma jets, which likewise come from the contact region, are also accommodated by the shield. As a result, the voltage-insulating function of the ceramic sleeve on the vacuum interrupter chamber inside is maintained. A high electrical field strength is present at the edges of these introduced shielding components, particularly under test conditions.

The plasma jets impinging on the shield heat it locally, with the result that material fusing and vaporization can occur. This can firstly increase the vapor pressure within the vacuum interrupter chamber during the switching operation and can secondly cause the shield to fuse completely. Particular loading of the shield occurs in the case of a compact design of the vacuum interrupter chamber with frequent switching of short-circuit currents.

The high erosion strength required cannot be achieved by the conventionally used shielding materials in this form, however, or can only be achieved incompletely.

SUMMARY

The disclosure is therefore based on the object of increasing the dielectric strength at the edges or rounded portions of the subcomponents used, which edges or rounded portions result within the vacuum interrupter chamber in structural terms. In the region of the contact pieces, the erosion resistance of the shield is intended to be improved.

A vacuum interrupter chamber with an insulating ceramic wall is disclosed, within which contact pieces, which are capable of moving in the vacuum, are arranged and are surrounded concentrically by a shield between the contact piece and the interrupter chamber wall, wherein coatings of high-melting material or of refractory metals are applied at least partially in the region of the shield or other component parts within the vacuum interrupter chamber.

BRIEF DESCRIPTION OF THE DRAWING

The disclosure is illustrated in an exemplary embodiment and described in more detail below.

DETAILED DESCRIPTION

Figure 1:
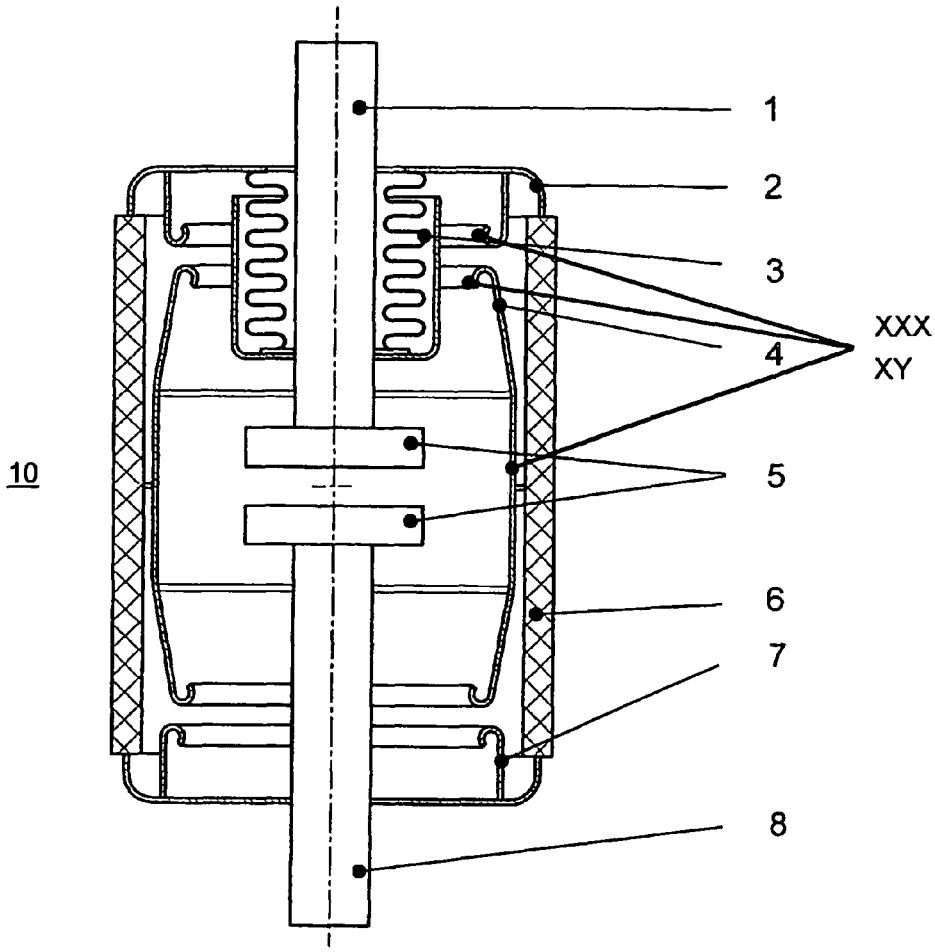
FIG. 1 shows a longitudinal section through a vacuum interrupter chamber.

The concept of the disclosure is in this case to provide the shields or said shielding parts, which lie directly opposite the contact system region, with a particularly high-melting material coating. The thickness of the high-melting layer applied in this case which is to be selected therefore needs to be dimensioned in such a way that, during a short-circuit current disconnection, the energy generated in the process by radiation can be absorbed substantially in this layer and can be dissipated to the substrate without the shielding arrangement, or whatever component parts are coated thereby, being capable of fusing to a very great extent depending on the circuit or being capable of fusing completely prematurely as a consequence.

For the shields this means that they are coated in the region of the relevant edges or rounded portions with this material having a high dielectric strength. This means that a high electron work function and/or a mechanically high hardness is brought about. In this case, this layer can be relatively thin. In a further advantageous configuration, this layer can therefore be applied by chemical coating, sputtering or vapor deposition.

During opening of the contact pieces under load, an arc is produced with the above-described effects. Plasma-induced erosion of the material is markedly reduced at the coated edges and surfaces, as a result of which, firstly, the fusing of the shields is reduced and, ultimately, complete fusing of the shield can be prevented.

In addition, an increase in the dielectric strength of a shielding arrangement is achieved. Very high electrical field strengths are present at the edges of these introduced shielding components, in particular under dielectric test conditions. In addition to the mentioned erosion resistance, the dielectric strength at the edges and rounded portions of the shield or other components is intended to be increased.

The edges or rounded portions of the shields should therefore be coated with a material having a high dielectric strength. This is achieved by a high electron work function and/or a mechanically high hardness.

The dielectric strength of the arrangement or device in particular at the shielding edges is increased. In this case it should also be mentioned that a corresponding edge board is arranged on the so-called central shield and is guided towards the outside, and shield control, i.e. corresponding driving of the mid-potential, is possible.

The layer on the components can in this case be designed to be relatively thin. These coatings can comprise the above-mentioned elements, mixtures and/or alloys in said form, for example TiN, TiN+$Al_2O_3$, TiCN, TiAlN, C at least partially in a diamond structure or else in a mixture with tungsten, hard-metal coatings comprising WC or the like and also cermets.

These regions illustrated in the drawing below by XY comprise these mentioned material composites, with the possibility not being ruled out of these coatings also being capable of being applied in the regions XXX, and vice versa.

In a further exemplary configuration, in this case the layer can also be formed from nanoparticles, which can have correspondingly optimum properties as a result of their structure.

Particularly high-melting or refractory metals are used for coating purposes on the surface of a component, said metals being applied in the form of nanoparticles or as a layer, i.e. as a closed layer on the substrate, in this case the shielding component, in regions or else completely. The materials used include the following elements: tungsten, chromium, molybdenum, vanadium, titanium, tantalum and carbon. In the drawing below, the abovementioned elements for the coating are selected for the regions denoted there by XXX.

Furthermore, the coatings can comprise mixtures and/or alloys in said form, for example TiN, TiN+$Al_2O_3$, TiCN, TiAln, C in a diamond structure, hard-metal coatings comprising WC or the like and cermets. These regions illustrated by XY in the following drawing comprise these mentioned material composites.

The application of these particles or layers can take place using a chemical route. A further possibility for the application of a layer to a component is dipping/brushing/spraying or physical vapor deposition (PVD) or chemical vapor deposition (CVD) processes by means of sputtering/vapor deposition or by means of chemical surface reaction.

FIG. 1 shows a longitudinal section through a vacuum interrupter chamber 10. The switching contacts 5 are arranged within the vacuum interrupter chamber. In this case, one switching contact is arranged fixedly 8 and another is arranged above a folding bellows 3 movably 1 with respect thereto within the vacuum interrupter chamber. Optionally, two movable contacts can also be used, each contact piece being driven correspondingly and being guided to the outside via metallic bellows with a push rod. The two metallic conductors 1, 8 are electrically insulated from one another by an insulator 6. The cover components 2 illustrated in this arrangement take on the function of producing a connection between the insulator 6 and the bellows on one side and the conductor 8 on the other.

Within the vacuum interrupter chamber 10, in this case shields 4, 7 are arranged in this sectional illustration, essentially in this case a central shield 4 can be seen which is placed in the region around the actual contact point. At the illustrated highlighted edges, i.e. in particular but not exclusively there, the central shield is coated with the corresponding material XXX or the material composite XY, in accordance with the respective abovementioned materials or elements, alloys etc.

During opening of the contact pieces under load, an arc is produced, with the above-described effects. Plasma-induced erosion of the material is markedly reduced at the coated edges and surfaces, as a result of which, firstly, the fusing of the shields is reduced and, ultimately, complete fusing of the shield can be prevented, and secondly the dielectric strength of the arrangement or device in particular at the shielding edges is also increased. In this case it should also be mentioned that a corresponding edge board is arranged on the so-called central shield 4 and is guided towards the outside, and shield control, i.e. corresponding driving of the mid-potential, is possible.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A vacuum interrupter chamber, comprising:

an insulating ceramic wall;

contact pieces, at least one of the contact pieces being capable of moving;

a shield between at least one of the contact pieces and the wall; and at least one coating of high-melting material or of refractory metals applied on at least part of the shield, wherein the at least one coating comprises nanoparticles such that the at least part of the shield having the at least one coating comprising the nanoparticles applied thereon has an increased dielectric strength and an increased hardness relative to any part of the shield not having the at least one coating applied thereon.

2. The vacuum interrupter chamber as claimed in claim 1, wherein the high-melting material of the at least one coating comprises at least one of the elements: tungsten, chromium, molybdenum, vanadium, titanium, tantalum, and carbon.

3. The vacuum interrupter chamber as claimed in claim 2, wherein said at least one coating is applied to the corresponding part of the vacuum interrupter chamber by means of a PVD or CVD process, by means of being sputtered on or vapor-deposited or by means of a chemical reaction or by means of an injection-molding technique or dipping or brushing or spraying.

4. The vacuum interrupter chamber as claimed in claim 1, wherein the nanoparticles comprise tungsten, or molybdenum, or tantalum, or vanadium, or titanium, or chromium, or carbon.

5. The vacuum interrupter chamber as claimed in claim 1, wherein the nanoparticles comprise a CuCr alloy.

6. The vacuum interrupter chamber as claimed in claim 1, wherein the nanoparticles comprise a composite material.

7. The vacuum interrupter chamber as claimed in claim 6, wherein the composite material comprises CuCr with Cr>1%.

8. The vacuum interrupter chamber as claimed in claim 6, wherein the composite material comprises WCu, or MoCu.

9. The vacuum interrupter chamber as claimed in claim 6, wherein the composite material comprises TiN, or TiN+$Al_2O_3$, or TiCN, or TiAlN.

10. The vacuum interrupter chamber as claimed in claim 6, wherein the composite material comprises WC.

11. The vacuum interrupter chamber as claimed in claim 1, wherein the shield concentrically surrounds the contact pieces.

12. The vacuum interrupter chamber as claimed in claim 1, wherein the shield is metallic and the at least one coating is applied directly on the shield.

13. The vacuum interrupter chamber as claimed in claim 12, wherein the at least one coating surrounds the contact pieces.

14. The vacuum interrupter chamber as claimed in claim 1, wherein the at least one coating is applied on other component parts within the vacuum interrupter chamber.

15. The vacuum interrupter chamber as claimed in claim 1, wherein the at least one coating comprises a single element, and wherein the nanoparticles consist of one of tungsten, molybdenum, tantalum, vanadium, titanium, chromium, and carbon.

* * * * *